United States Patent [19]

Tastavin et al.

[11] Patent Number: 4,778,438

[45] Date of Patent: Oct. 18, 1988

[54] FABRIC STACKING DEVICE

[75] Inventors: Serge Tastavin, Nimes; Didier Turquet, St-Mamert; José/0 Garcia, Milhaud; Bruno Frac, Nimes, all of France

[73] Assignee: Eminence S.A., France

[21] Appl. No.: 857,125

[22] Filed: Apr. 29, 1986

[30] Foreign Application Priority Data

Apr. 29, 1985 [FR] France ..... 85 06478

[51] Int. Cl.[4] ..... D05B 33/02; B65H 29/50; B65H 29/56; B65H 45/04

[52] U.S. Cl. ..... 493/27; 493/406; 493/417; 493/446; 112/121.29; 271/175

[58] Field of Search ..... 112/121.29; 271/175; 493/23, 27, 204, 405, 406, 412, 416, 417, 446, 455, 459, 465, 466, 480

[56] References Cited

U.S. PATENT DOCUMENTS

| | | | |
|---|---|---|---|
| 3,371,631 | 3/1968 | Rockerath | 112/121.29 |
| 3,500,780 | 3/1970 | Emus et al. | 112/121.29 |
| 3,704,884 | 12/1972 | Nicolay et al. | 271/175 |
| 3,741,052 | 6/1973 | Frost et al. | 112/121.29 |
| 3,752,470 | 8/1973 | Buss et al. | 493/406 |
| 3,788,248 | 1/1974 | Marforio | 112/121.29 |
| 4,016,989 | 4/1977 | Furnari | 271/175 |
| 4,067,272 | 1/1978 | Marforio | 112/121.29 |
| 4,144,825 | 3/1979 | Angele et al. | 112/121.29 |
| 4,214,541 | 7/1980 | Zeigler, Jr. et al. | 112/262.3 |
| 4,624,615 | 11/1986 | Russell et al. | 112/121.29 |

FOREIGN PATENT DOCUMENTS

| | | |
|---|---|---|
| 1571192 | 6/1969 | France . |
| 2326525 | 4/1977 | France . |
| 506478 | 1/1986 | France . |
| 1021888 | 3/1966 | United Kingdom . |

*Primary Examiner*—Frederick R. Schmidt
*Assistant Examiner*—William E. Terrell
*Attorney, Agent, or Firm*—Steele, Gould & Fried

[57] ABSTRACT

A device for stacking pieces of fabric which includes a fold bar, at least one gripper movable in translation for grasping succesive pieces of fabric on the fold bar, a fold bar support which is movable between a rear position and a front position for receiving the pieces of fabric from the outlet of a sewing machine, a stacking table positioned adjacent to the fold bar, the gripper being driven in an alternating motion between a position in which it is located over the fold bar support when the support is in its rear position, and a position in which it is located over the stacking table and a guide bar which faces the stacking table at a level which is higher than the greatest possible height to which the fabric can be stacked.

11 Claims, 6 Drawing Sheets

FABRIC STACKING DEVICE

The present invention relates to a device which is intended particularly, but not exclusively, for stacking a piece of fabric, such as knitted goods in the course of manufacture.

BACKGROUND OF THE INVENTION

Various different systems are known for stacking objects. When stacking pieces of cloth or knitting, the fabric to be stacked is completely lacking in rigidity and is incapable of sliding over another piece of textile, thereby preventing newspaper or plastic bag stacking devices which rely on the physical characteristics of the object to be stacked from being used when stacking pieces of fabric. After cutting, garment manufacture requires various pieces of fabric (woven or knitted cloth) to be assembled in succession on assembly lines. These various different operations are performed at different locations along the assembly line and require numerous handling operations between one work station and the next. In addition, flat pieces of cut fabric are shaped so as to be suitable for covering a three-dimensional volume, and as a result their shape when laid out flat is generally highly irregular. They are incapable of sliding over one another and must be transported and put down from above on a stack which is being built.

In order to reduce handling time, and given that the various successive operations take different lengths of time, it is common to store part-finished articles temporarily at work stations in stacks for subsequent delivery to subsequent work stations, frequently via automated conveyor built systems.

Given the above-mentioned difficulties, the handling operations (stacking, turning, folding, etc . . . ) which are performed after a given manufacturing operation is completed to ensure that the partially completed work is properly presented to the next work station are currently performed manually. Although such stacking and possible folding operations are essential, they considerably increase manufacturing costs since work ceases at the associated work station while they are being performed.

Devices for stacking pieces of fabric have already been described in the following patent specifications: FR-A-No. 2 326 525, FR-No. 1-1 571 192, GB-A-No. 1 021 888, and U.S. Pat. No. 214 541. The devices described in these patent specifications are indeed capable of bringing together several pieces, but they are not capable of forming stacks each of which is of predetermined and adjustable shape as a stack, and each of which is capable of being built up from differently shaped articles.

U.S. Pat. No. 4 214 541 describes an arrangement in which article folding means are provided in a stacking apparatus, said folding means being synchronized with cutting operations in order to fold an article (a pillowcase) in half.

These means are constituted by a fixed folding bar in the form of a blade for forming the transverse fold line. The edges of the article fall under gravity on either side of the bar and the article is grasped from this position by grippers and placed on a conveyor belt. However, such a device is incapable of properly stacking irregularly shaped pieces.

A first object of the present invention is to provide an automatic stacking device enabling the operator of a sewing station, for example, to be released from the need to present articles properly to the next work station. The operator can thus concentrate solely on assembly work, per se.

A second object of the present invention is to provide a device which is entirely automated and which enables accurate and repetitive stacking to be performed in such a manner as to ensure that the stacks are presented in a constant manner and that they all include a given number of pieces.

A third object of the present invention is to provide a device capable of automatically unloading stacks, and thus constituting a step towards full automatiation, at least in the manufacture of certain simple items.

SUMMARY OF THE INVENTION

According to the present invention, a fabric stacking device includes the improvement of a support for a piece of fabric, at least one gripper for grasping the piece of fabric, a vertically movable unloading table, and a guide bar, said gripper being driven with an alternating motion between a position in which it is located above said support and a position in which it comes over said vertically movable unloading table, with said guide bar being disposed facing said table.

In its simplest version, when the fabric pieces are merely to be stacked without any other manipulation between the outlet from a work station fabric processing machine, e.g. a sewing machine, and a stacking table, the device serves to grasp a piece of fabric at the outlet from the work station and to convey it over the stack being formed. Alternating vertical table movement serves to keep the top of the stack at a substantially constant level with a piece of fabric is put onto the stack, regardless of the current height of the stack.

According to an optional feature of the invention, the support for receiving the piece of fabric at the outlet from the fabric processing machine is mounted on a moving platform driven with an alternating horizontal motion between the outlet from said machine and the inlet to the table on which the stack is to be formed.

According to another optional feature of this invention, the support is provided with side extension means. Thus, after a piece of fabric has been placed on the support, the support may be extended in such a manner as to cause the piece of fabric to be spread out in a substantially vertical plane, thereby enabling it be placed substantially flat on the stacking table.

According to another optional feature of the invention, the support is pivotally mounted on the moving platform, with the pivot angle of the support being adjustable. It is thus possible to bring the top part of the support below the table on which the machine stands in order to enable the articles to be turned.

According to another optional feature of the invention, the device includes an alignment jack equipped with a gripper for grasping the edge of a piece of fabric to align it with the support so that the grippers can grasp said piece of fabric at predetermined locations when transporting it to the stacking table.

According to another optional feature of the invention, the device includes a sizing jack for placing a piece of fabric so that it is folded along a given line, e.g. a line of symmetry, regardless of the intended size of the completed garment.

BRIEF DESCRIPTION OF THE DRAWINGS

An embodiment of the invention is described by way of example with reference to the accompanying drawings, in which.

MORE DETAILED DESCRIPTION

Generally speaking, all versions of the stacking device are controlled by a controller which serves to set in motion the various actions required in sequence for the device to operate. The controller is itself set into motion from the machine for performing the main fabric processing operation, and supposing that this machine is a sewing machine, the controller may be started from the work station per se, and various controller parameters, e.g. concerning the sizes of the fabric pieces to be stacked, may also be set from the work station. It is also possible for the main machine which controls operation of the stacking device controller, to be itself controlled by the stacking device controller for such-and-such a generally final operation. In other words, the main work station machine and the stacking device interact with each other, and in particular, the stacking device may cause the operation of the main machine to be stopped once a predetermined number of fabric pieces have been stacked on the stacking machine table.

In the specific example described below, by way of example, the main machine is a sewing machine for sewing the top of a pair of underpants or other undergarment for the lower trunk, comprising a waist opening and two leg openings, with an elastic waist band being fitted around the waist opening, the machine simultaneously placing the elastic waist band, sewing it in place, and cutting the top portion of the underpants.

The piece of fabric received from the previous work station comprises an assembly of all the component parts, namely the front and back parts sewn together along their common base line, together with an optional pocket which may be merely tacked on or over-casted. The machine under consideration cuts out the waist band portion and sews on a strip of elastic for constituting the waist band around the outside of the article, which at this moment is in the form of a strip having notches intended to become the leg-holes. The article is finished on the next work station which performs a second side over-casting operation to close the stitching. For this to be done, the article must be turned prior to stacking, as described below. However, the present invention is naturally not limited in any way to this specific operation, nor to this specific garment and it may be employed even for stacking mere rectangular strips of fabric.

Figure 1:
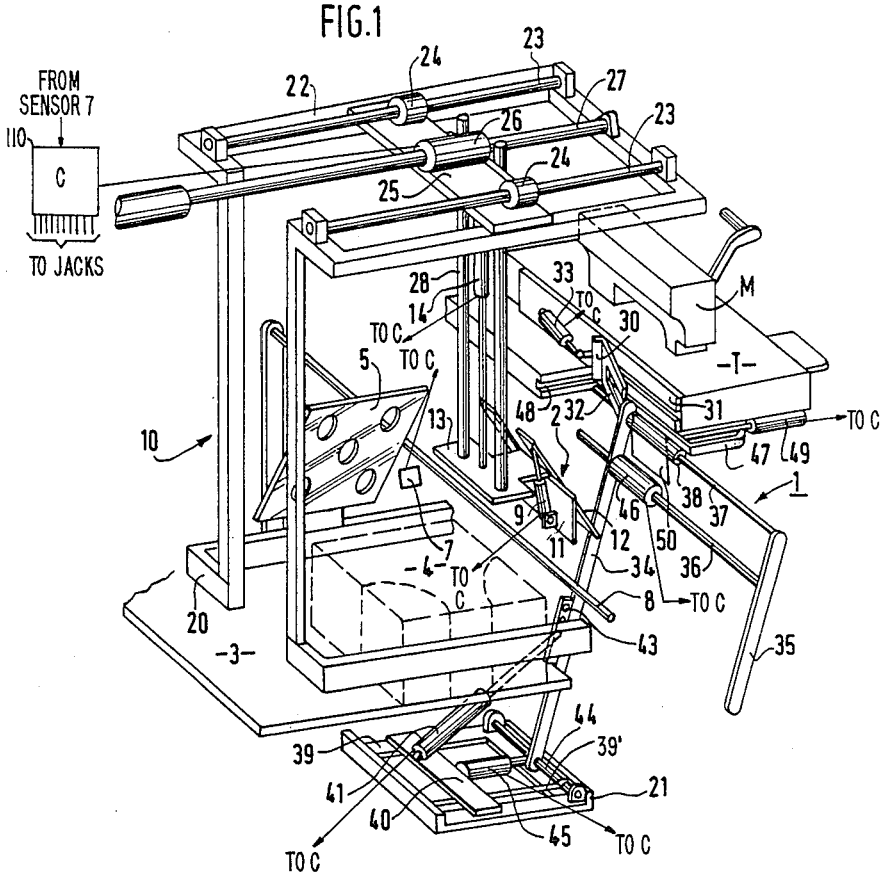
FIG. 1 is an overall perspective view of a work station and an associated stacking device.

FIG. 1 shows a sewing machine M with a device in accordance to the invention disposed at its outlet. The device shown diagrammatically in FIG. 1 is essentially constituted by a support 1 for receiving pieces from the outlet of the sewing machine M which is mounted on a table T, grasping means 2 capable of taking pieces from the support 1, and a stacking table 3. The grasping means 2 move horizontally. The simplest operation of the device is as follows: the piece falls under its own weight onto the support 1; it is grasped by the grasping means 2; and is transported onto the stacking table 3. However, as is described below, the device may also fold the piece and/or turn it. The term "turn" is used without specifying whether the piece of fabric is turned "over" or "insideout", since these operations are not distinct at all stages of garment manufacture.

In FIG. 1, the various members are mounted on a frame 10 which stands on the ground, and on the table T of the sewing machine M. The base 20 of the frame is supported directly on the ground (not shown in FIG. 1, for reasons of clarity) as is the base 21 of the support 1 which is situated between the table 3 and the machine M. The top 22 of the frame 1–10 supports slides 23 along which bearings 24 fixed to a plate 25 are free to slide. The plate 25 is fixed to a magnetic sleeve 26 which is driven magnetically by a magnet (not shown) which is itself moved by means of a fluid under pressure inside the tube 27. The plate 25 carries two vertical guides 28 having a support 13 sliding therealong, which support is fixed to the rod of a jack 14. The purpose of the jack is to raise and lower the gripping means or grippers 2 so that they may grasp a textile piece located on the support 1, lift it, and then transport it to a position above the stacking table 3. There are two grippers 2 in the example shown, and each comprises a fixed jaw 11 fixed to the support 13 and a moving jaw 12 hinged thereto, with the moving jaw 12 being fixed to the rod of a small jack 9 whose cylinder body is fixed to the fixed jaw 11. Extending the rod of the jack 9 causes the gripper 2 to close, and retracting its rod causes the gripper to open. A cover of non-slip fabric is advantageously applied to the insides of the jaws 11 and 12.

Thus, the grippers 2 are capable of opening and closing under the control of the jacks 9, of moving up and down under the control of the jack 14, and of moving horizontally from between a positive over the support 1 and a position over the stacking table 3. Naturally, all these motions are controlled by a controller C 110 starting from the moment the sewing machine M has finished with the piece of fabric.

The stacking table 3 has a stack of pieces of fabric 4 being built up thereon. As mentioned above, and in accordance with one of the features of the invention, the stacking table 3 is capable of moving vertically up and down in alternation under the control of a plurality of jacks (not shown). It is desirable for the pieces of fabric (e.g. knitted cloth) to be placed on the stack 4 in an appopriate disposition, and in the example shown, this disposition is horizontally. The height of the stack being built relative to the ground must thus remain constant regardless of the number of articles in the stack. It is not possible to adjust the level of the top of the stack accurately simply by lowering the table 3 by the thickness of one article each time a piece of fabric is placed thereon. The table is therefore lowered and raised after each piece of fabric is put on the stack. Each time it rises, it is stopped in the desired position as determined by a sensor 7.

In addition, after a piece of fabric has been placed uncreased on the stack 4, it is necessary to flatten it to expel any air which may be contained therein, thus preparing the stack to receive the next article. To this end, the device includes a presser flap 5 which is hinged about a fixed horizontal axis. This flap is movable between a substantially vertical position as shown in FIG. 1 when the grippers arrive above the stack, and a horizontal position when the grippers have moved away forwardly. The movement of the presser flap 5 is controlled by a rotary actuator (not shown). When the table 3 moves upwardly, with the flap 5 being in its horizontal position, the top of the stack 4 is pressed against the flap 5. A guide-bar 8 whose function is explained below is located at the inlet to the table 3 and is fixed to the frame of the device.

When the main fabric processing machine is to work flat on a portion of a piece of fabric which is to be closed to substantially constitute a circumference, the sewn piece is rotated, e.g. when sewing on an elastic waist band, the waist band moves substantially circularly as explained below. However, in order for the stacking device to work properly, it is necessary to have a reference point on the piece of fabric so that all articles (which may be of different sizes) can be stacked repetitively. To this end, the device includes an alignment gripper 30 which is driven in horizontal translation along the front face (see FIG. 1) of the table T by a jack (not shown). This gripper includes a fixed jaw 31 having a moving jaw 32 hinged thereto. The gripper 30 is closed under the control of a small jack 33.

At the end of each sewing operation which corresponds to a given length of machine operating time, the gripper 30 moves towards the outside of the fabric processing machine under the control of its jack. During this movement it grasps a portion of the piece (which when an elastic waist band is being sewn in place, is the back of said piece) and the jaw 32 closes on the jaw 31. After closing, the gripper performs a rapid pulling movement which pulls the grasped portion of the waist band over the support 1. During this operation the elastic tape constituting the waist band has not yet been cut so that the article remains connected to the next article by said waist band. By virtue of the alignment gripper, one edge of the fabric piece always falls in an accurate position on the support 1. As described below, the stacking device uses gravity for putting the pieces onto the support 1. After the elastic waist band has been cut, the article is held by urging the support 1 against an abutment 50 in the manner described below.

So far, the support 1 could have been of any shape. All that was required was for it to be suitable for receiving the pieces falling from the sewing machine after the elastic tape has been cut, which pieces were pulled by the gripper 2.

When it is desirable for the piece coming from the sewing machine to be spread out so as to enable it to be placed flat on the stack, the support 1 is advantageously constituted by two parallel risers 34 and 35 which are interconnected by at least one rod 36. The rod 36 is controlled by a jack 46 which serves to vary the distance of the riser 35 relative to the riser 34 which remains in a fixed plane. Preferably, the transverse rod 36 is merely a control rod which drives a support bar 37 which is slidably mounted in a bearing 38. When the support 1 is fixed, the grippers 2 grasp the piece spread over the bar 37, transport it vertically, and deposit it horizontally, with the change in position being caused by the guide-bar 8. Thus, the piece leaving the sewing machine is spread over the support 1 and is transported onto the stacking table 3. Naturally, in order to spread the piece, one edge must be held while it is being spread. To this end, the support 1 pinches the edge of the piece nearest to the sewing machine (to the left in FIG. 1) against the abutment 50 which also serves to prevent the piece from falling after the elastic tape constituting its waist band has been cut.

In some applications, it is necessary not only to spread the piece but also to turn it. This is the case, for example after an elastic waist band has been put into place and sewn on the outside, and where the following sewing operation for closing the waist band and the garment takes place on the inside of the garment. In accordance with the invention, a support 1 is then provided which is movable between the outlet from the sewing machine M and the stacking table 3. As shown in FIG. 1, the support 1 stands on the frame 1 which itself stands on the ground. When the device is in the rest position, the support 1 is vertical. Two horizontal slides 39,39" are fixed on the hose 21 and a cross-bar 40 is slidable thereon. The cylinder body of a jack 41 is pivotally mounted on the cross-bar 40 and the rod of the jack is hinged at 42 on a flat 43 having a plurality of holes to enable the stroke of the said rod of the jack 41 to be adjusted. Thus, the riser 34 is capable of pivoting about a shaft 44 carried by the hose 21. The shaft 44 is fixed to the rod of a jack 45 for displacing the set of parts constituting the support 1 in horizontal translation over the frame 21. Thus, the risers 34 and 35 and the bars 36 and 37 are capable of being moved over the table T of the machine behind the outlet plane of the sewn pieces. As a result, if the pieces are over-sewn on the outside of the finished article, the face of the piece which comes into contact with the support 1 is the inside face thereof, and the first half of the piece comes into contact with the front face of the support. Given the position of the support, the second half of the article falls down the other side of the support, folding the article on the support substantially level with its base where the front and back portions of the finished garment are sewn together, thus enabling the piece to be turned prior to stacking.

However, in order to stack properly, it is necessary for the base of the piece of fabric to rest on the bar 37 regardless of the size of garment being made. To this end, the device enables the distance travelled by the piece of fabric between the outlet of the sewing machine M and the support 1 to be adjusted. To do this, it includes a sizing jack 49 whose body is disposed below the table T of the sewing machine M and whose rod is fixed to a slide 47 having one free end and having its other end guided in a groove 48 in which it can take up a number of predetermined positions (e.g. 3) corresponding to large sizes, to medium sizes, and to small sizes. Instead of falling directly onto the support, the piece slides over the slide 47 which is at a distance from the front face of the table T as determined by the position of its end in the groove 48. This size adjustment device is not described when describing the operation of the stacking device, since for any given size its position is fixed once and for all from the work station. Each time an article drops, the jack 49 displaces the slide 47 to a fixed distance from the table T of the sewing machine M so that the distance travelled by the article before reaching the support is adjusted so that the bottom seam, or more generally the fold line, is exactly placed on the top bar 37 of the support. Thus, the piece held by the support 1 falls onto the support under its own weight and turns as soon as contact between the support 1 and the abutment 50 is released by the top of the support moving backwards.

Reference is made to the simplified diagrams of FIGS. 2 to 6 while describing the operation of the stacking device. These figures only show those members which are necessary for describing the particular operations concerned, and they bear the same reference symbols as used in FIG. 1.

Figure 2:
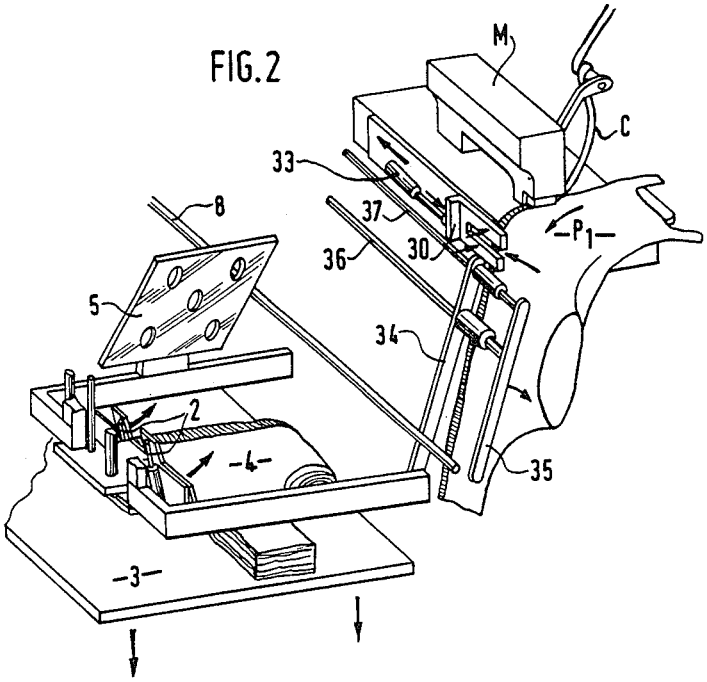
FIGS. 2 to 6 are diagrams showing the stages through which a textile piece passes on the way to being stacked.

In FIG. 2, it can be seen that the sewing machine M includes a supply of elastic tape C, which tape is sewn to the top of a piece P whose right face P1 (i.e. the face which will be the outside face in the finished garment) faces upwardly while being sewn on the sewing machine. The elastic is shown being stitched into place. The leading end of the piece falls over the front face of the table T and slides over the slide 47. The support 1 pivots forwardly so that it comes into contact with the right face P1 of the piece of fabric. Simultaneously, the table 3 moves downwardly while the flap 5 is raised. The grippers 2 begin to move towards the sewing machine. When the stitching has been finished, the gripper 30 drops the piece P and aligns it with the edge of the table T.

Figure 3:
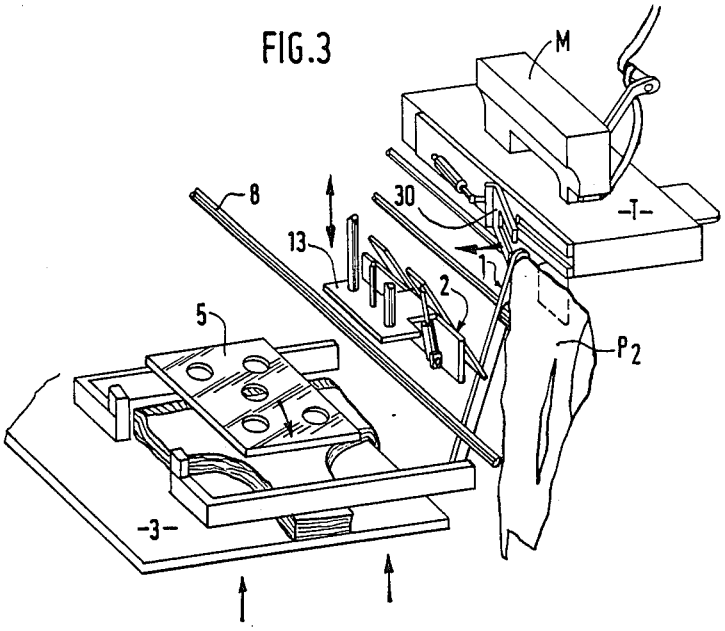

In FIG. 3, the flap 5 has returned to its horizontal position and the table 3 has risen to the level determined by the sensors 7 (see FIG. 1). The alignment gripper 30 is open. The elastic tape C is cut so that the piece P falls onto the support with its wrong face P2 (i.e. the face which will be on the inside of the finished garment) facing away from the support, and with the base of the garment resting on the bar 37 by virtue of the sizing jack and its slide 47. At this moment the piece P is dangling from a single point on its waist band. The grippers 2 arrive over the support 1 away from the stacking table.

Figure 4:
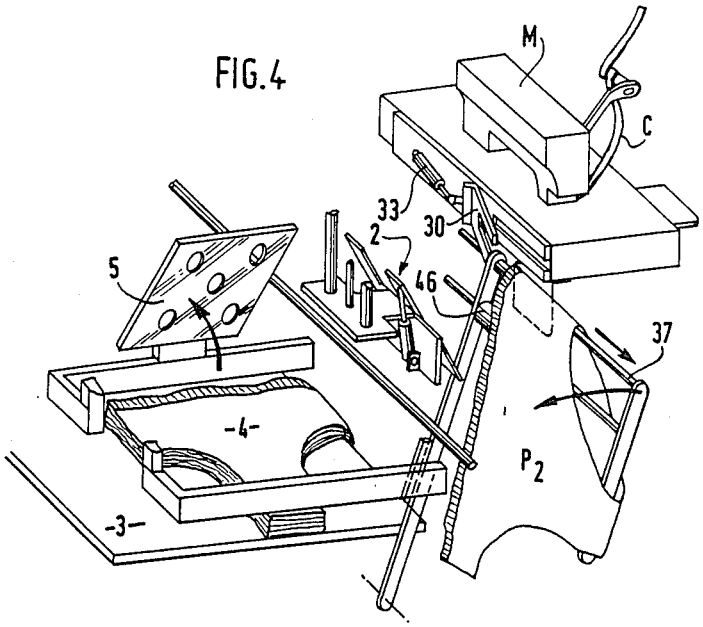

In FIG. 4, the piece P is spread by means of the jack 46 so that a corner of the support 1 projects through a leg hole.

Figure 5:
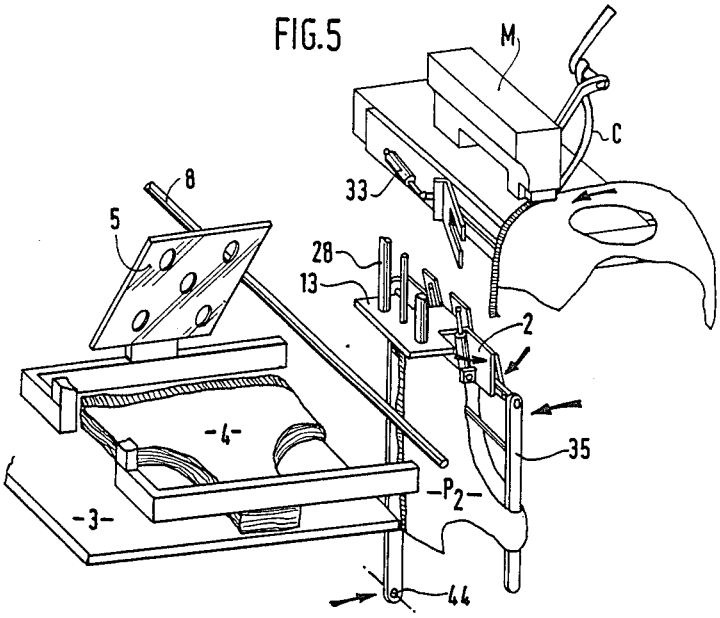

As can be seen in FIG. 5, the piece P whose wrong face P2 is visible in the figure is then grasped by the grippers 2 which move upwardly lifting the piece off the support 1 which has previously been moved into a vertical position and then tilted towards the stacking table 3 under the control of the jack 41 (see FIG. 1) so as to facilitate removal of the part P from the support 1.

In accordance with a feature of the invention, and in order to avoid creases forming, the support 1 is driven by the jack 45 to follow the grippers 2 over a portion of their stroke, said portion extending practically up to the inlet to the table 3.

Figure 6:
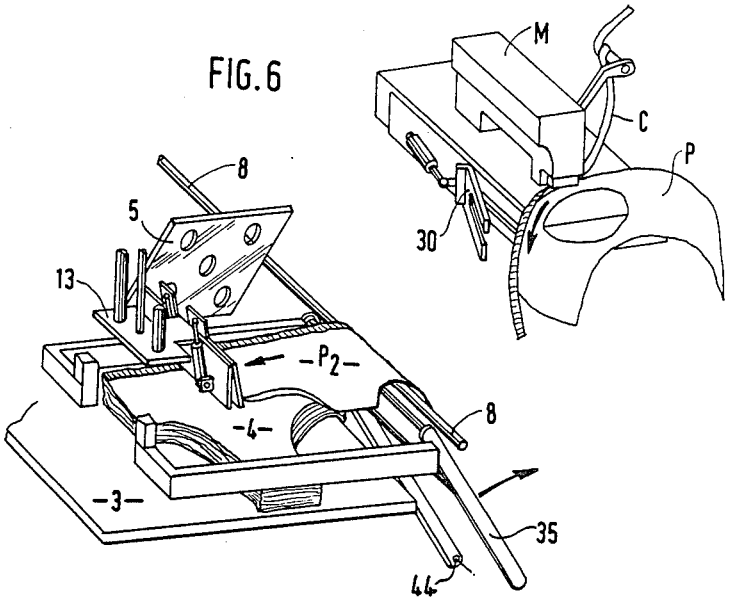

FIG. 6 shows how the face P2 of the piece P passes from a substantially vertical position to a substantially horizontal position. The flap 5 is raised to allow the grippers and the piece P to pass over the stack. The grippers 2 continue their translation movement towards the back of the table 3 while driving the base of the piece. The guide bar 8 avoids the piece P coming into contact with the top of the stack 4 which is being built, since such contact would spoil the stack. The grippers open at the end of their stroke and the piece P is placed on the top of the stack 4. The trailing end of the piece P is held up by the bar 8. Pulling the piece P over the bar 8 also serves to remove creases. The support 1 then tilts back again towards the table T. Sewing has already begun on a new piece P.

The device thus returns to the position shown in FIG. 2. As it moves downwards, the table 3 causes the trailing edge of the top piece on the stack to be pulled over the guide-bar 8. When the table rises again, this trailing portion remains below the guide bar. A new cycle can begin and a new piece can be added to the stock.

As mentioned above, the sensor 7 (FIG. 1) continuously monitor the height of the stack 4, which height is representative of the number of articles in the stack, although the relationship between the height and the number of articles changes with differing aticles. Once the desired height of stack has been achieved, this information is transmitted to the controller which stops the above-described operation. At this moment, the table 3 is displaced in a horizontal plane towards the sewing machine to enable the operator to pick up the stack and put it on a conveyor belt. This horizontal displacement is performed using jacks (not shown). It is also possible to provide an automatic stack unloading system, in which case the table 3 should be moved so that it comes directly over a conveyor belt.

We claim:

1. A device for folding and stacking pieces of fabric from an outlet of a processing machine and being controlled by a controller comprising a piece support bar having a base positioned at the outlet of the processing machine, the support bar being movable relative to the base from a first position immediately adjacent to the processing machine such that the piece of fabric falls on said support bar, to a second position spaced from the processing machine;

a stacking table spaced from the processing machine and having an edge facing the processing machine, the base of the support bar being located between the processing machine and the stacking table, a frame juxtaposed to the stacking table, the frame comprising a plate and a support mounted below the plate;

at least one gripper mounted on the support and adapted to grasp said piece of fabric from said support bar and deposit the same on said stacking table, the support being horizontally displaceable and perpendicularly displaceable relative to the piece support bar, the plate being carried on a horizontally movable slide and said support and mounted gripper being movable between a vertical position equal to the height of the piece support bar and said stacking table and movable between a horizontal position adjacent to the edge of the stacking table facing the processing and said support bar;

a guide bar fixed in position above the said edge of the stacking table, the said gripper being displaceable above said guide bar; and means to displace the stacking table vertically periodically to maintain the last stacked piece at a constant level.

2. A device according to claim 1 in which the piece support bar is pivotally mounted upon the base, the piece support bar being adapted to be moved pivotally between the processing machine and the stacking table.

3. A device according to claim 2, and a jack with an alternating horizontal motion, the jack being mounted on the base and being adapted to reciprocate the support bar between substantially the outlet from said processing machine and the said edge of the stacking table.

4. A device according to claim 3, wherein said support comprises two risers which are interconnected by crossbars, said risers being pivoted about a shaft fixed to said base, with the pivot angle of the support being controlled by the jack.

5. A device according to claim 1, wherein the support bar is provided with extender means suitable for spreading out a piece of fabric laterally in a substantially vertical plane.

6. A device according to claim 1 wherein the processing machine is mounted on a table comprising an alignment gripper movable along the table, said alignment gripper being suitable for grasping an edge of a piece of fabric and for bringing it to a predetermined reference position.

7. A device according to claim 6 comprising a jack mounted on the table, said jack including a rod which is fixed to a slider for adjusting the distance between the outlet from said machine and the top of said support, said slider being extended each time a piece is dropped.

8. A device according to claim 1 and a sensor, the sensor being provided for measuring the height of the stack after each piece has been placed on the stacking table, said sensor sending a signal when said height corresponds to a reference value to stop operation of said device and displacing said stacking table so that it may be unloaded.

9. A device according to claim 8 wherein an abutment is provided on the table for with said support bar and for cooperating therewith to hold a piece of fabric on the support bar after said piece of fabric has been released from said processing machine.

10. A device according to claim 1 and a jack connected to the base to move the support bar in horizontal translation synchronously with said gripper, thereby avoiding creasing the piece of fabric.

11. A device according to claim 1, wherein said gripper comprised first and second jaws, an actuator jack for controlling displacement of said jaws relative to one another.

* * * * *